US005277145A

United States Patent [19]

Hordis

[11] Patent Number: 5,277,145

[45] Date of Patent: Jan. 11, 1994

[54] TRANSOM FOR A BOAT

[75] Inventor: Robert C. Hordis, Beverly, N.J.

[73] Assignee: C. C. Omega Chemical, Inc., Moorestown, N.J.

[21] Appl. No.: 950,968

[22] Filed: Sep. 23, 1992

Related U.S. Application Data

[63] Continuation of Ser. No. 550,859, Jul. 10, 1990, abandoned.

[51] Int. Cl.[5] ..... B63B 5/24

[52] U.S. Cl. ..... 114/357; 114/355; 114/65 R; 114/69

[58] Field of Search ..... 114/57, 69, 56, 74 A; 82, 65 R, 343, 355, 357, 358, 428/116, 117, 308.4, 325; 440/49; 264/7, 46, 239, 241, 250, 257; 151/190, 191, 192

[56] References Cited

U.S. PATENT DOCUMENTS

| | | | |
|---|---|---|---|
| 3,080,267 | 3/1963 | Schmalz | 114/357 |
| 3,093,847 | 6/1963 | Strecker | 114/357 |
| 3,124,813 | 3/1964 | Graef | 114/357 |
| 3,282,761 | 11/1966 | Evangelist | 114/357 |
| 3,634,898 | 1/1972 | Geiger | 114/357 |
| 3,831,212 | 8/1974 | Moore | 114/357 |
| 4,161,796 | 7/1979 | Kostanecki | 114/357 |
| 4,760,811 | 8/1988 | Hopper | 114/357 |
| 4,892,054 | 1/1990 | Davidson | 114/357 |
| 5,000,106 | 3/1991 | Rheney | 114/357 |
| 5,036,788 | 8/1991 | Unger | 114/357 |
| 5,111,767 | 5/1992 | Haines | 114/357 |

*Primary Examiner*—Robert J. Oberleitner
*Assistant Examiner*—Clifford T. Bartz
*Attorney, Agent, or Firm*—John F. A. Earley; John F. A. Earley, III

[57] ABSTRACT

A boat hull includes a stern section known as a transom which comprises an outer transom wall, an inner transom wall spaced apart from the outer transom wall, and a core of syntactic foam comprising a plurality of microspheres encapsulated in a resin inserted between the outer transom wall and the inner transom wall.

3 Claims, 3 Drawing Sheets

TRANSOM FOR A BOAT

This is a continuation of copending application Ser. No. 07/550,859 filed on Jul. 10, 1990, now abn.

BACKGROUND OF THE INVENTION

1. Field of the Invention

This invention relates to a transom for boats, and more specifically concerns a transom for pleasure or work boats having outboard motors or inboard/outboard motors.

2. Description of the Prior Art

Many pleasure and work boats today are constructed of synthetic resin plastic material reinforced by fibers. The most common fiber used is glass fibers, such as Fiberglass, and the most common synthetic resin plastic used is a polyester resin.

The fibers may also be Kevlar man-made fibers or carbon fibers, but, because of the cost and complexity in applying these materials, they are used in only a small percentage of fiber-reinforced plastic boats. Kevlar is a registered trademark of E. I. du Pont de Nemours and Company, Wilmington, Del.

The synthetic resin plastic material may also be an epoxy resin, a vinyl ester resin, a urethane/polyester resin, or any other suitable synthetic resin plastic material.

Aluminum is second in popularity to fiber-reinforced synthetic resin plastic as a construction material for the hulls of pleasure boats.

The majority of such boats are powered by outboard motors or inboard/outboard motors. Some also are sailboats, deriving their main propulsion force from the wind, with the outboard motor or inboard/outboard motor providing intermittent propulsion as needed.

Such boats are provided with a transom, which is an upright, transverse portion of the hull that fits across the stern of the boat. The power source of the boats is an outboard motor which is mounted outboard of the transom on an extension bracket or hung directly from the transom, or an inboard/outboard motor which is mounted inboard of the transom with its drive shaft extending through a hole in the transom to a drive unit containing the propeller which drive unit is mounted outboard of the transom. The power source of an inboard/outboard is mounted directly on the transom, but may also be supported by brackets which extend from the hull reinforcing stringers. The power source exerts a considerable force on the transom when the boat is being started, and also when the boat is underway. The transom must be constructed very sturdily to resist the propulsion force of the motor.

Conventionally, the transom comprises a plywood sheet, one-half to one-and-one-half inches thick, sandwiched between outer and inner layers of the basic hull material of fiber-reinforced synthetic resin plastic.

Also conventionally, the hull of a pleasure boat may be constructed of fiber-reinforced synthetic resin plastic in the following way. An outer hull liner is constructed by providing a female mold for the hull outer liner, and coating the mold with a wax or some other release agent. Then a polyester resin containing a coloring agent ("gel coat") is sprayed onto the mold to form a smooth outer layer of approximately 0.020 to 0.030 inches which is then allowed to cure. A layer of polyester resin and glass fibers is placed onto the gel coat layer and allowed to cure. Successive layers of glass fiber reinforced polyester resin are applied to the mold and allowed to cure to build up the thickness of the hull outer liner to a desired thickness. Then a smooth inner layer of polyester resin may be added to conceal the glass fibers from view. The hull is then separated from the mold. Other synthetic resins may be substituted for the polyester resin in this method of making a boat hull.

Again conventionally, the transom is formed by gluing together two sheets of plywood using, for example, a resin, to form a laminated sheet of plywood, and then gluing the laminated plywood sheet to the inside surface of the stern wall of the outer liner of the hull. The laminated plywood sheet is clamped onto the inside surface of the outer liner until the resin sets. The inner plywood surface which is exposed to view from the bow of the boat is then coated manually with layers of polyester resin-saturated glass fibers. Again, other synthetic resins may be used in place of the polyester resin.

The inner surface of the laminated plywood sheet which is exposed to view from the bow may also be covered by a preformed hull inner liner that is mated to the hull outer liner. The hull inner liner is made in a manner similar to the hull outer liner, with successive layers of polyester resin and glass fibers being applied to a mold, except that a male mold is used instead of a female mold.

The conventional inboard/outboard transom includes an opening cut into the transom to accommodate the mounting of the drive unit to the motor, the drive unit being a separate entity from the motor.

In an outboard motor boat, the outboard motor is mounted on the transom so that it hangs outside the boat and no opening in the transom is needed.

With an inboard/outboard motor, the motor is mounted inside the transom and is connected to the drive unit through the cut-out portion of the transom.

One of the major problems of outboard motor boats and inboard/outboard motor boats is that the plywood in the conventional transom tends to rot because the water penetrates into the plywood sheets.

In outboard motor boats, water leaks into the plywood of the transom through poorly sealed joints, or through failed seals for various fittings in the transom such as ski tow rings, hull drain plugs, etc.

In inboard/outboard motor boats, the plywood in the transom rots when water penetrates into the plywood around the opening for the motor to drive unit connection, or through failed seals for various fittings in the transom such as ski tow rings, hull drain plugs, etc.

The rotting of the plywood in the transom is a major problem not only for boat owners, but also for boat manufacturers who must spend large sums to repair or replace damaged transoms on warranty claims resulting from such water damage.

Another major problem of boat manufacturers is the time delay in the production of boats caused by the length of time it takes to make a conventional boat transom. It takes time to allow the adhesives to cure that bind the laminated plywood sheets to the hull. Also, putting the plywood in place by hand, and clamping it to hold it there by hand, involves a substantial amount of time and labor.

SUMMARY OF THE INVENTION

It is an object of this invention to provide a boat transom that is impervious to water.

It is another object of the invention to provide a boat transom that is strong enough to withstand the start up and propulsion forces applied to the transom by the motor(s).

It is another object of the invention to provide an easy and inexpensive method for constructing a boat transom.

It is another object of the invention to provide an easy and inexpensive method for providing a finished surface to the inner surface of a boat transom.

It is another object of the invention to provide a means to construct a boat transom which allows naval architects and structural engineers to vary the thickness of a boat transom from side to side and top to bottom in accordance with the stress imposed in the various areas of the transom, thereby reducing hull weight and cost of material.

It is another object of the invention to reduce installation time for the drive units for inboard/outboard powered boats by pre-locating the cut-out section required for the assembly of the drive unit to the motor.

It is another object of the invention to provide a method for constructing a boat transom that decreases the time required on the assembly line for the construction process of the transom.

In accordance with these and other objects of the invention, there is shown a boat transom having an outer transom wall, an inner transom wall spaced away from the outer transom wall, and a core between the walls comprising a syntactic foam of resin-encapsulated microspheres. Syntactic foam is defined in the dictionary as any of several buoyant materials made up of tiny hollow spheres embedded in a surrounding plastic material. The syntactic foam used as the core material between the inner and outer walls is actually a structural material with substantial strengths in compression, sheer, and tension of its own, as well as being a bonding agent which, as it cures, firmly attaches to the inner and outer walls of the transom, forming a strong, sandwich structure.

Offset keys are formed in the inner transom sheet and project aft to provide proper spacing of the inner transom wall from the outer transom wall for insertion of the syntactic foam core. The offset keys may be positioned to prelocate various fittings which are to be installed later.

Vertical ribs may be positioned between the inner transom wall and the outer transom wall to strengthen the transom and/or to reduce the amount of syntactic foam used in the assembly. These are not shown in the drawings, as they are not necessary in the practice of the invention.

The preferred syntactic foam is INJECTACORE syntactic foam which is manufactured by C.C. Omega corporation and sold by C. C. Omega Chemical Inc., both at 900 Peebles Industrial Park, Wildwood, Fla. 32785, and comprises a multiplicity of hollow microspheres of silicate glass encapsulated in a polyester. Other synthetic resin plastics may be substituted for the polyester if desired, and other types of hollow microspheres may be substituted for the silicate glass microspheres if desired. The microspheres may be those sold under the trademark Q-Cel by the Specialty Chemicals Division of PQ Corp., Valley Forge, Pa. Q-Cel microspheres range in particle size from 10 to 200 microns, and in displacement density from 0.16 to 0.46 grams per cubic centimeter.

DETAILED DESCRIPTION

Figure 1:
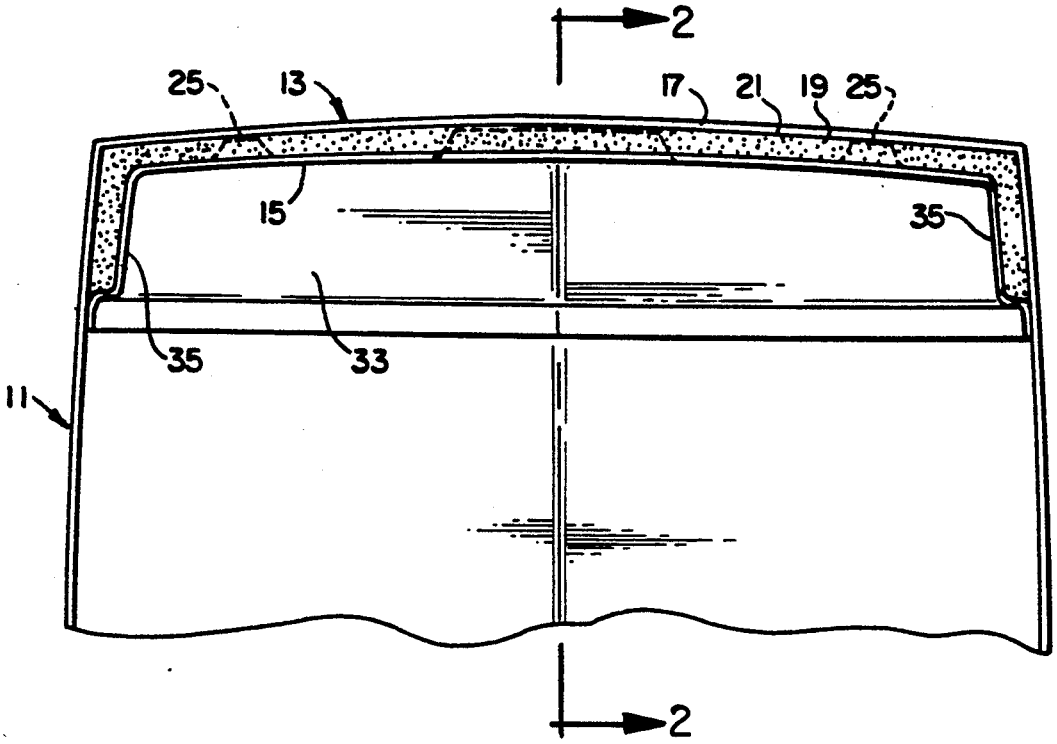
FIG. 1 is a view in horizontal section of the stern of a boat showing an inboard/outboard transom constructed in accordance with the invention.
Figure 2:
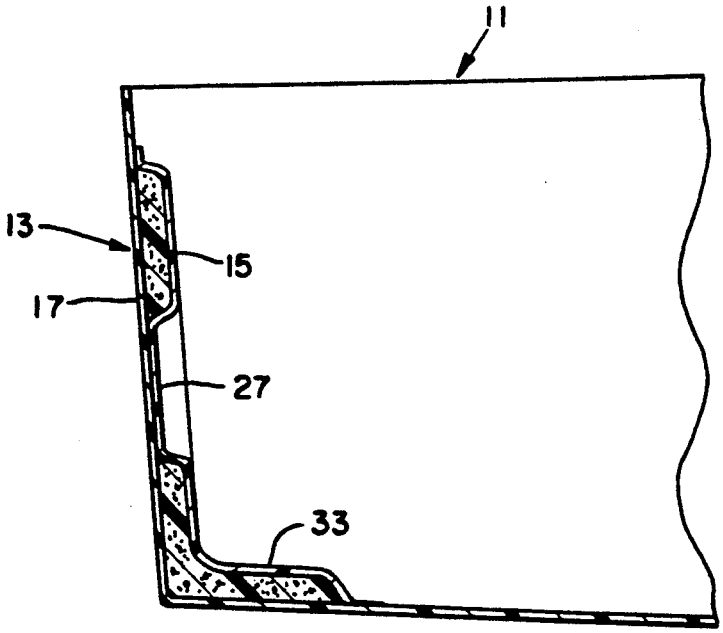
FIG. 2 is a view in vertical section of the inboard/outboard transom taken as indicated by the lines and arrows 2—2 which appear in FIG. 1.
Figure 3:
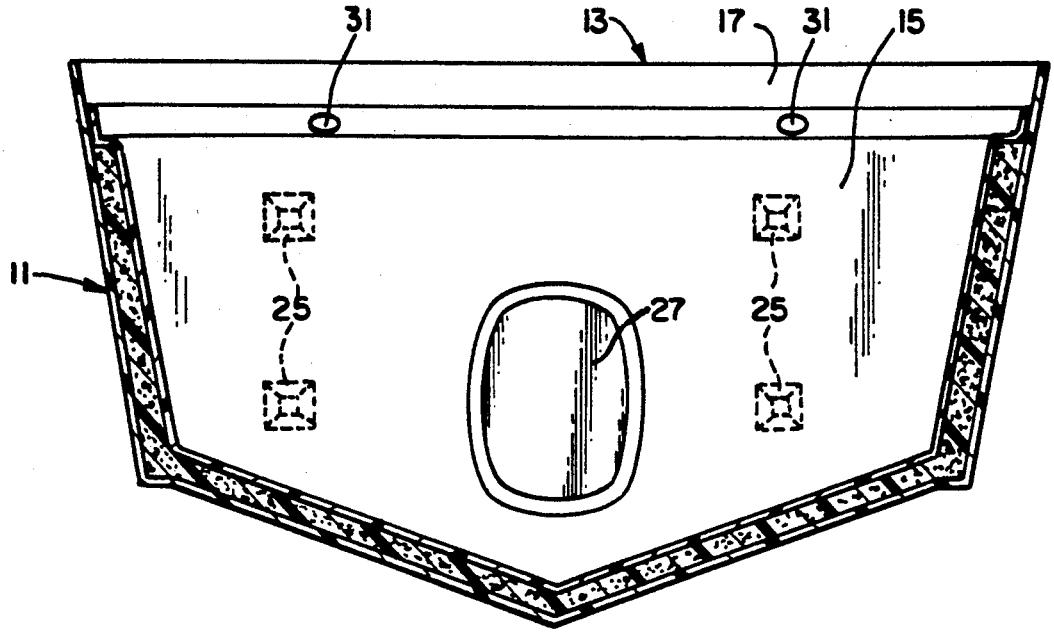
FIG. 3 is a view in front elevation of the inboard/outboard transom taken from inside the boat looking rearwardly toward the transom, with the sides and bottom of the boat shown in section.

Turning to FIGS. 1-3 of the drawings, a boat hull 11 is shown that has a curved (though it can be flat) inboard/outboard transom 13 with an inner transom wall 15 which is a separate sheet that is attached along its side, top, and bottom edge portions to the inside surface of the hull 11, an outer transom wall 17 that is an integral part of the hull 11, a space 19 between walls 15 and 17, and a core 21 of syntactic foam filling the space 19.

Spacing means, such as offset keys 25, may be formed on inner transom wall 15 and project rearwardly into space 19 between walls 15, 17 toward outer transom wall 17 to provide proper spacing of inner transom wall 15 from outer transom wall 17 and proper thickness of core 21.

Recess 27 (FIG. 2) acts as a positioning means for the motor and the outdrive.

Holes 31 (FIG. 3) are drilled through inner transom wall 15 at its top section after it is removed from the male mold to allow entry of the wand or hose used to inject the syntactic foam in a liquid state into the cavity formed between walls 15 and 17.

Inner transom wall 15 is preferably preformed and then connected to outer transom wall 17 by adhesive or other means, as preferred by the builder.

Inner transom wall 15 may be preformed with indentations to accommodate, among other things, the insertion of stringers that stiffen the bottom of hull 11. Inner transom wall 15 may also be provided with indentations to identify the proper positions for drilling holes for mounting bolts for an inboard/outboard motor, ski tow rings, etc., none of which are shown in the drawings.

Turning now to FIG. 2, the inner transom wall 15 is shown as a single piece with a bottom lip 33 that is turned-in toward the bow of the boat hull, and is generally perpendicular to the main body of inner transom wall 15. The turned-in portion 33 of inner transom wall 15 is attached or bonded to the bottom of the interior of boat hull 11. As shown in FIG. 1, inner transom wall 15 may also include turned-in side lips 35 that are bonded to the inside side walls of boat hull 11.

Instead of being formed as a single separate piece, inner transom wall 15 may be formed as an integral part of a hull inner liner, with the transom wall 15 being mated and attached to, but spaced from the hull outer liner 17. In this method, all indents and offset keys to the outer transom wall, such as 25 and 27 in FIG. 3, are eliminated to allow removal of the hull inner liner from the male mold on which it was formed, unless such protrusions as would be required on the male mold to form these indents and protrusions in the hull inner liner are constructed to be removable from the male mold before removing the hull inner liner from the male mold.

In accordance with this invention, a method of making a transom 13 for a boat 11 includes the steps of molding the hull 11 having an outer transom wall 17 by applying successive layers of an outside coating which generally contains a coloring agent, resin, and fibers, to a female mold and allowing the wall 17 to cure; molding an inner transom wall 15 separately by applying successive layers of an inside smooth coating which generally contains a coloring agent, resin, and fibers to a male mold and allowing the transom inner wall 15 to cure; attaching inner transom wall 15 to the inside side walls and the upper section of the inside of outer transom wall 17 and to the inside and bottom walls of boat hull 11 at a spaced-apart distance from outer transom wall 17; injecting a syntactic foam of resin-encapsulated microspheres into the space 19 between inner transom wall 15 and outer transom wall 17 to form a core 21, and allowing the core 21 to cure.

The syntactic foam can be inserted into space 19 in a liquid form by injection means through a hose or a hollow wand and the discharge end of the wand is lowered to the bottom of space 19 to begin the injection process, and is withdrawn at a rate to allow its discharge end to remain slightly above the rising level of the liquid syntactic foam, thereby insuring complete filling of space 19 while avoiding trapping air bubbles that would occur if other methods of filling, such as pouring, were used. Other methods of filling space 19 with the syntactic foam can be used, such as pouring, but such other methods are less desirable due to the possibility of trapping air in bubble form which would result in a weakening of the transom structure.

The cure time of the liquid syntactic foam may be varied according to the user's desires. When cured, the syntactic foam becomes a solid which strongly attaches to the outer and inner transom layers, becoming stiff but somewhat flexible to prevent cracking and breaking.

The method produces a transom 13 that is impervious to water damage, faster to construct than conventional transoms, and more durable than conventional transoms.

Furthermore, transom 13 is lighter than conventional transoms because the resin-encapsulated glass microspheres in core 21 weigh less per cubic foot than the plywood used in conventional transoms.

Figure 4:
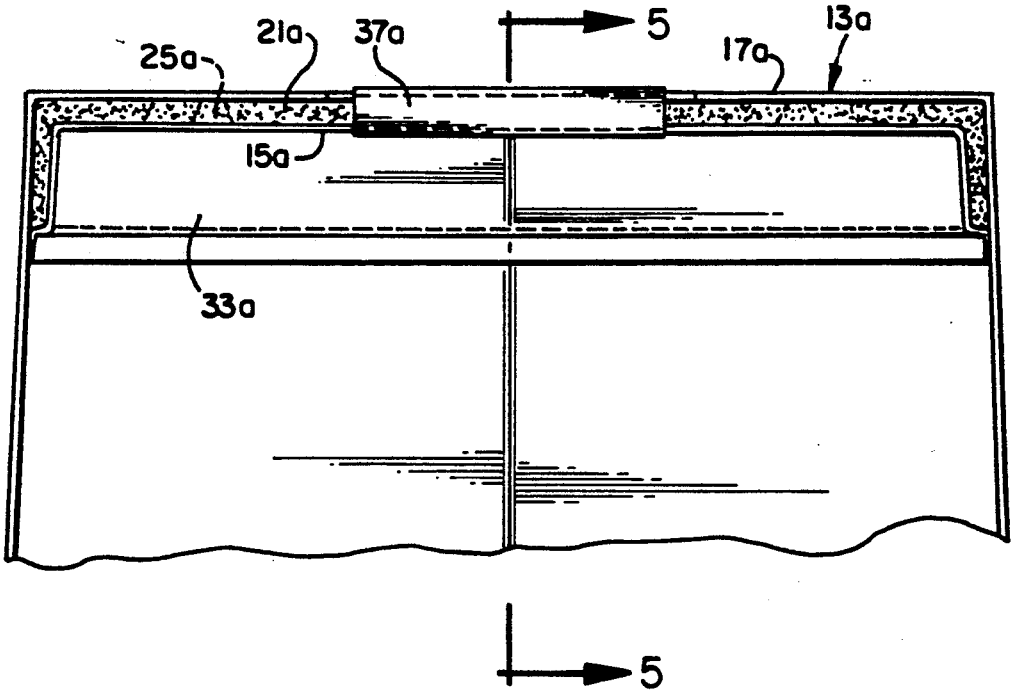
FIG. 4 is a view in horizontal section of the stern of a boat showing an outboard transom constructed in accordance with the invention and shows the outboard transom as being flat, instead of the curved transom of the inboard/outboard transom of FIG. 1.
Figure 5:
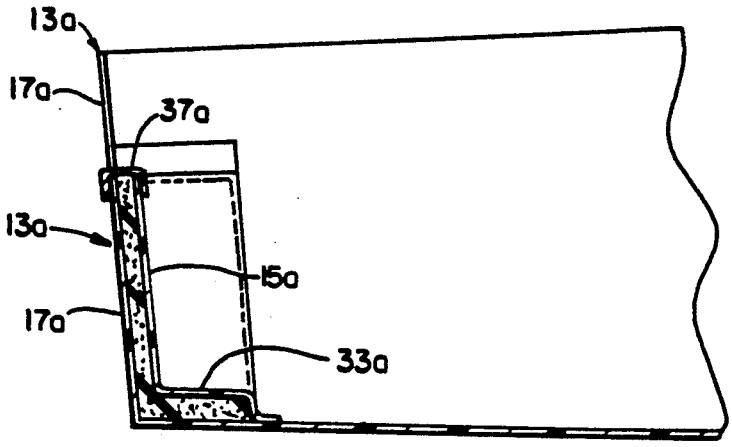
FIG. 5 is a view in vertical section of the outboard transom taken as indicated by the lines and arrows 5—5 which appear in FIG. 4.
Figure 6:
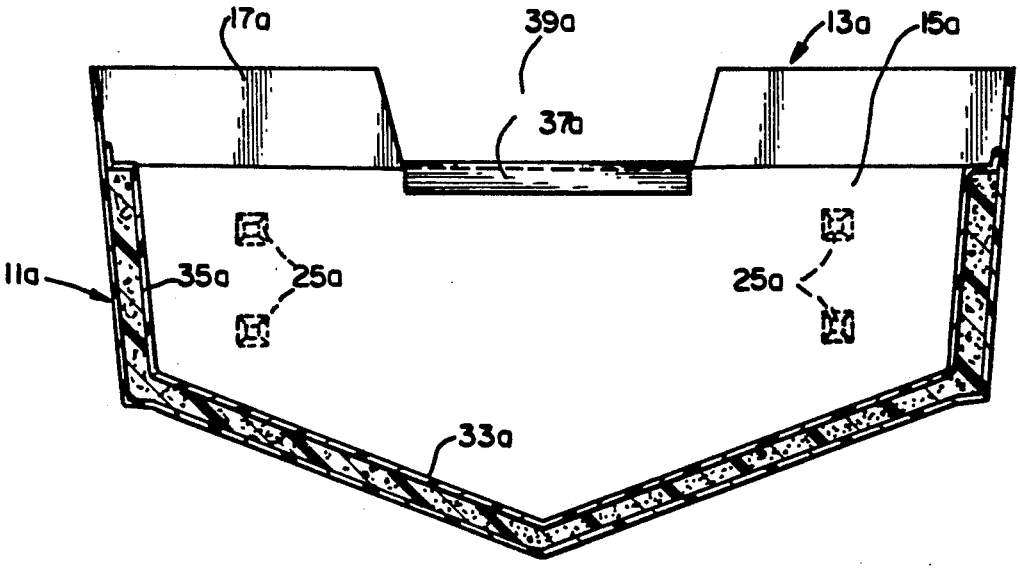
FIG. 6 is a view in front elevation of the outboard transom taken from inside the boat looking rearwardly toward the transom, with the sides and bottom of the boat shown in section.

FIGS. 4, 5 and 6 show a flat transom 13*a* embodiment of the invention for use on outboard powered boats, wherein the propulsion system is suspended from the transom 13*a*, with the propulsion system being attached by clamps and/or thru bolts to the transom 13*a* and being completely outside of the boat. A cap of aluminum or other material is usually fastened over the top of the transom in a conventional transom assembly using plywood as the core material, in order to protect the plywood from water. While this cap protection is not necessary with this invention, an aluminum cap 37*a* may be provided for aesthetic reasons over the top of notch 39*a* in transom 13*a*.

The syntactic foam used as the core material between the inner and outer walls is actually a structural material with substantial strengths in compression, sheet, and tension of its own, as well as being a bonding agent which, as it cures, firmly attaches to the inner and outer walls of the transom, forming a strong, sandwich structure.

Offset keys 25*a* are used to insure that the desired thickness of the syntactic foam core 21*a* is maintained.

It will be realized that other modifications may be made to the invention as shown and described, without departing from the spirit and structure of the invention as defined in the attached claims.

I claim:

1. A boat hull having a bow and an aft section with a transom comprising a hull having a rear outer hull wall formed integrally with the hull as an integral part of the hull, said hull having an inside surface, a rear inner wall which is a separate sheet positioned in the hull spaced-apart forwardly from the rear outer hull wall to form a space between the rear inner wall and the hull, said rear inner wall having top, bottom, and side edge portions, a low density core in said space and in intimate contact with the inside surface of the rear outer hull wall and the inside surface of the rear inner wall, said low density core comprising a syntactic foam means for firmly attaching said hull and said rear inner wall together, said syntactic foam means being formed of a plurality of microspheres encapsulated in a resin, offset key means formed on the rear inner wall and projecting rearwardly into the space between the rear inner wall and the rear outer hull wall to provide proper spacing between the rear inner wall and the hull and to provide proper thickness of the core, a bottom lip on the rear inner wall that is turned-in toward the bow of the boat hull and is generally perpendicular to the rear inner wall, said boat hull having a bottom wall with an inside surface, said turned-in bottom lip being bonded to the inside surface of the bottom wall of the boat hull, said inner rear wall also including turned-in side lips that are turned-in toward the bow of the boat hull, said boat hull having side walls with inside surfaces, adhesive means binding said turned-in side lips to the inside surfaces of the side walls of the boat hull, a top lip on the rear inner wall that is turned back towards the rear of the boat hull, and adhesive means bonding said top lip to the inside surface of said rear outer wall.

2. The boat hull of claim 1, said boat hull being without a metal grid between said rear outer wall and said rear inner wall.

3. The boat hull of claim 1, said boat hull being without a plywood transom board between said rear outer wall and said rear inner wall.

* * * * *